US008695526B1

(12) United States Patent
Ringer et al.

(10) Patent No.: US 8,695,526 B1
(45) Date of Patent: Apr. 15, 2014

(54) SELF-SCUTTLING VESSEL

(75) Inventors: Charles M. Ringer, La Jolla, CA (US); Earl Floren, San Diego, CA (US); Peyton Hall, San Diego, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 105 days.

(21) Appl. No.: 13/445,579

(22) Filed: Apr. 12, 2012

(51) Int. Cl.
*B63G 8/14* (2006.01)

(52) U.S. Cl.
USPC ..... 114/331; 114/312; 204/196.02; 204/248; 102/402

(58) Field of Classification Search
USPC ..... 114/331, 312; 204/248
See application file for complete search history.

(56) References Cited

U.S. PATENT DOCUMENTS 3,308,046 A * 3/1967 Suleski ..... 204/196.02
3,629,091 A * 12/1971 George ..... 204/248
4,301,761 A * 11/1981 Fry et al. ..... 114/331
4,649,744 A * 3/1987 Cotillier ..... 73/170.34
4,972,776 A * 11/1990 Shumaker et al. ..... 102/402
5,493,993 A * 2/1996 Carter et al. ..... 114/312
6,209,816 B1 * 4/2001 Hitomi et al. ..... 242/322
7,690,247 B1 * 4/2010 Lapota et al. ..... 73/61.51

OTHER PUBLICATIONS

John Petrovic et al., Reaction of Aluminum with Water to Produce Hydrogen, A Study of Issues Related to the Use of Aluminum for On-Board Vehicular Hydrogen Storage, U.S Department of Energy, 2010, USA.
Gaute Svenningsen, Corrosion of Aluminum Alloys, Department of Materials Technology, 7491 Trondheim, Norway.

* cited by examiner

*Primary Examiner* — Lars A Olson
*Assistant Examiner* — Jovon Hayes
(74) *Attorney, Agent, or Firm* — SSC Pacific Patent Office; Kyle Eppele; Arthur K. Samora

(57) ABSTRACT

A self-scuttling device can include a pressure hull that can define an internal void having an internal pressure $P_{VOID}$. The device can be disposed in an underwater environment having a pressure $P_{AMBIENT}$ that is greater than $P_{VOID}$. The pressure hull can be formed with a fill port, which can be selectively opened to flood the void. A reactive agent can be disposed within the void. The reactive agent can be chosen to mix with seawater and establish a solution that corrodes the pressure hull when the reactive agent is exposed to seawater by flooding the void. The reactive agent can be disposed within a watertight container, which maintains watertight integrity at $P_{VOID}$, but loses watertight integrity at the greater $P_{AMBIENT}$. When this occurs, the reactive agent becomes exposed to seawater to establish the solution within the void that corrodes the pressure hull.

18 Claims, 4 Drawing Sheets

SELF-SCUTTLING VESSEL

FEDERALLY-SPONSORED RESEARCH AND DEVELOPMENT

This invention (Navy Case No. 101119) is assigned to the United States Government and is available for licensing for commercial purposes. Licensing and technical inquires may be directed to the Office of Research and Technical Applications, Space and Naval Warfare Systems Center, Pacific, Code 72120, San Diego, Calif. 92152; voice (619) 553-5118; email ssc pac T2@navy.mil.

FIELD OF THE INVENTION

The present invention pertains generally to systems that are designed for deployment in an aquatic environment. More specifically, the present invention pertains to a system and method for manufacture therefor that self-scuttles according to the needs of the user.

BACKGROUND OF THE INVENTION

Aquatic devices (devices that are designed to be deployed in an underwater environment) are well-known in the prior art, and the devices can be used for a variety of reasons. Many aquatic devices often remain in the aquatic environment after their useful life. This is can be due to a variety of reasons. The device can become detached from its mooring to due to weather and/or fouling, or the device can be deployed in the deep ocean, in a manner which would require significant effort to retrieve, or even be impossible to retrieve, due to the depth at which the device is located. Devices which remain in the aquatic environment after its useful life cycle can cause shipping hazards, or can cause other undesired results if allowed to remain in place. Thus, it may be desired to provide a device that maintains watertight integrity during its useful life, but then disintegrates once its useful life expires, or upon a remote command to self-scuttle.

In the case of devices utilizing metallic pressure vessels, it can be desirable to provide a self-scuttling system and method for a pressure vessel that is made of metal and that contains internal electronics. Once the vessel "fails" (loses watertight integrity by design as desired by the user) any internal electronics tray equipment can fail due to exposure to water (again, by design), and can be allowed to disintegrate or break apart after scuttling. The scuttle function as described can be either an intentional scuttle based on anticipated use of the device, or an unintentional scuttle, such as what would occur after the aquatic device is lost due to flooding or other failure, or if the operator loses control of the device but does not want the device to be recovered by third parties. In both intentional and unintentional cases, the device harmlessly decays. This technique could be used to cause any submerged metallic system, such as oceanographic equipment, sensors, fishing equipment, and oil field equipment to break apart in a controlled, designed, predetermined fashion.

U.S. Pat. No. 3,629,091, by Percy George for an invention entitled "Self-Destructing Metal Structures", uses an electrolyte between two metallic foils, one consisting of aluminum, and one of a more anodic material to cause the more anodic material to corrode, leaving behind the aluminum foil. The primary disadvantage to this approach, however, is that for a deep underwater environment, the thin foils described by George are too weak to resist the forces that pressure vessels must tolerate. Additionally, because a laminate material is used, the ability to form the material into shapes such as spheres and water tight cylinders is very limited and expensive, if not impossible, to accomplish. Additionally, it is necessary for the electrolyte in George to be exposed to water to perform its electrolytic function. As a result, only the inner layer of the laminate is resisting ocean pressure. This has the further disadvantage of beginning the corrosion reaction as soon as the device is exposed to water. A secondary disadvantage is that additional mass is added by containing the electrolyte within the gap between the metallic foils, thereby reducing payload capacity of the device for its intended purpose. In an undersea environment, seawater is readily available for use as an electrolyte.

In view of the above, it is an object of the present invention to provide a device that self-scuttles according to the desires of the user. It is another object of the present invention to provide a self-scuttling device that maintains watertight integrity to thereby provide much space within the interior of the device for a payload for the device, instead of the space being used for electrolyte. Yet another object of the present invention is to provide a self-scuttling device that can maintain watertight integrity in a relatively deep underwater environment until the scuttling function is activated by the user. Still another object of the device is to provide a self-scuttling device that is easy to manufacture in a cost-effective manner.

SUMMARY OF THE INVENTION

A self-scuttling device and methods for use in accordance with several embodiments of the present invention can include a pressure hull. The pressure hull can be made of a preselected hull material, and the pressure hull can define an internal void. The pressure hull can be disposed in an underwater environment having a pressure $P_{AMBIENT}$. The pressure hull can define an internal void having an internal pressure $P_{VOID}$, so that $P_{AMBIENT}$ is greater than $P_{VOID}$.

The device can further include a reactive agent that can be located within the void in several embodiments. The reactive agent can be chosen to mix with a fluid such as seawater to form a solution when the void is flooded. The seawater/reactive agent solution can function to chemically react with the pressure hull, to corrode the pressure hull from within. In several embodiments, the hull material for the pressure hull can be chosen to be Aluminum (Al), and for Al hull material, the reactive agent can be chosen from the group consisting of sodium hydroxide (NaOH) and potassium hydroxide (KOH). In some embodiments, the reactive agent can be disposed within a watertight container that can further be located within the void. The container can be made of a material that maintains watertight integrity at $P_{VOID}$ to keep the reactive agent dry, but that loses watertight integrity when the void is flooded to expose the container to the greater $P_{AMBIENT}$. In other embodiments, the reactive agent can be disposed within a container that is made of a flexible material that would yield to $P_{AMBIENT}$, with the flexible container being formed with at least one opening. For these embodiments, when fluid communication is established between the underwater environment and the void is flooded, $P_{AMBIENT}$ is greater than $P_{VOID}$, the flexible materials yields and the reactive agent can be forced out of the at least one opening to expose the reactive agent to the electrolytic seawater to establish the solution, which can cause the corrosion action on the pressure hull to occur.

The self-scuttling device according to several embodiments can include a means for selectively establishing fluid communication between the environment and the void to activate the reactive agent and thereby cause the corrosion of the pressure hull from within the void. In some embodiments, the fluid communications means can include a fill port that can be form in the pressure hull, and a remotely operated valve that can be disposed in the fill port. In other embodiments, the fill port can be covered by a material that deteriorates after a predetermined amount of time. In still other embodiments, a plug and explosive charge can be inserted into the fill port. The explosive charge can be remotely detonated to blow the plug out of the fill port. Each of these embodiments clears the fill port to establish fluid communication between the underwater environment and the void to accomplish the corrosive action and thereby scuttle the device. In some embodiments, the internal surface of the pressure hull can be scored, so that the pressure hull "breaks" along predetermined lines when the corrosive action of the reactive agent and hull material occurs.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
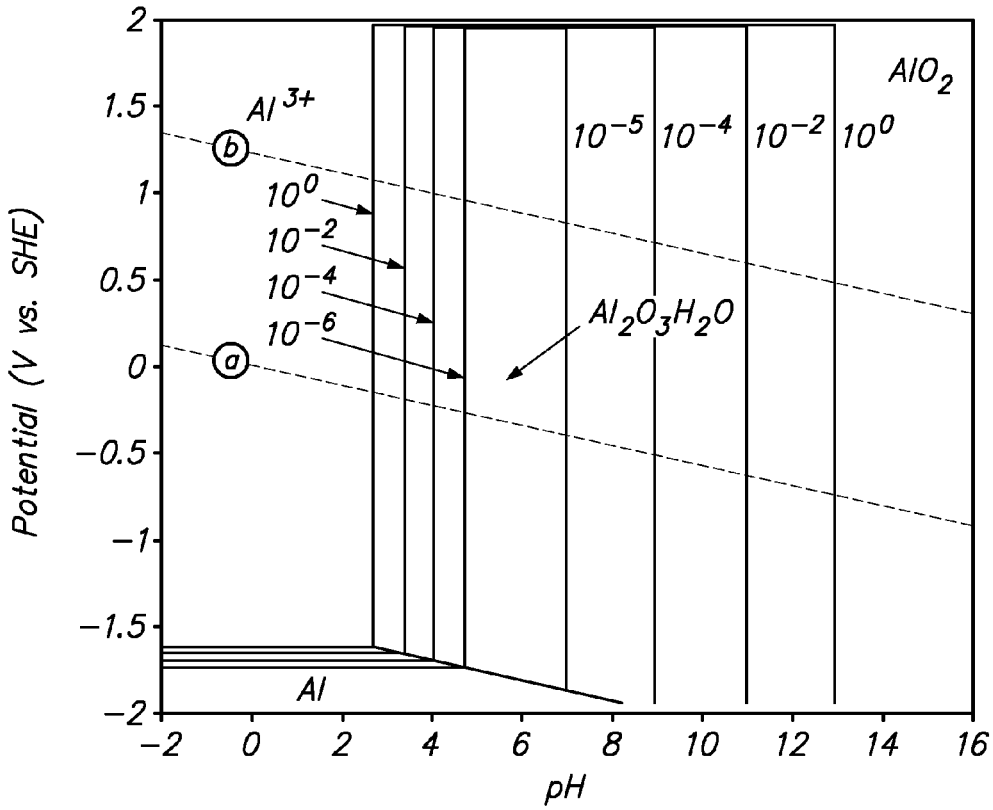
FIG. 1 is a Pourbaix diagram, which is used to show how the rate of corrosion of Aluminum is affected by the pH of various reactive agents, as aspect which can be incorporated into the present invention according to several embodiments.

In brief overview, and referring initially to FIG. 1, a Pourbaix diagram is displayed. In general a Pourbaix diagram, also known as a potential/pH diagram, is a graph of pH versus voltage potential with respect to the standard hydrogen electrode (SHE) as calculated by the Nernst equation. Pourbaix diagrams map out possible stable (equilibrium) phases of an aqueous electrochemical system. Predominant ion boundaries are represented by lines. FIG. 1 is a Pourbaix diagram for Al, which can illustrate the effect of a strong base agent, and how the base agent can be used to increase the rate of corrosion in Aluminum (Al).

A simplified Pourbaix diagram indicates regions of "Immunity", "Corrosion" and "Passivity", instead of the stable species. Thus, Pourbaix diagrams provide an indication as to the stability of a particular metal in a specific environment. Immunity means that the metal is not attacked, while corrosion shows that general attack will occur. Passivation occurs when the metal forms a stable coating of an oxide or other salt on its surface, the best example being the relative stability of aluminum because of the alumina layer formed on its surface when exposed to air.

As shown in FIG. 1, the strong base acts to locally increase the pH at which point the insoluble aluminum oxide layer becomes unstable. In the case of aluminum, both NaOH and KOH are capable of increasing the pH above the point at which the insoluble aluminum oxide, $Al_2O_3$, becomes unstable. In the pH range above 8.3, water has an increased effect on the corrosion of the aluminum metal because the soluble oxide $AlO_2$ is the most thermodynamically stable species of aluminum.

FIG. 1, however, does not however take into account the effect of halide salts on the oxide layer. An initial inspection of the diagram would lead one to believe that Al fully passivates in an aqueous solvent when the pH of the surrounding fluid is between 5.3 and 7, however, further inspection would reveal that the corrosion resistant range of aluminum is expanded to areas in which the concentration of the soluble species $Al^{3+}$ and $AlO^{2-}$ is less than $10^{-4}$, which occupies a pH of 4 and 8.3 respectively. Stated differently, any chemical which can be used to adjust the internal pH beyond the aforementioned range of either below 4.0 or above 8.3 can be used to affect the decomposition of the structure.

For the present invention according to several embodiments, NaOH is readily available and inexpensive, which can make NaOH an excellent candidate for use as a pH-modifying reactive agent. Potassium hydroxide, KOH, could also be used. There are numerous other chemicals which could be used to achieve a similar purpose on aluminum. Additionally, there are a near infinite number of permutations of chemical that are matched to materials such that a solid structure which is made of those materials can be enabled to decompose through the described systems and methods of the present invention.

For example, and in a similar manner to the aforementioned NaOH/KOH technique, the hydrofluoric acid (HF) approach can work as a reactive agent by decreasing the pH to approx 2.3. Tables published in the ASM International (formerly known as the American Society for Metals) handbook, *Aluminum: Properties and Physical Metallurgy* indicate that hydrofluoric acid increases the rate of corrosion of aluminum greater than acetic acid, hydrochloric acid, phosphoric acid, sulfuric acid, and nitric acid; however, the rates of decay are lower than those occurring when a strong base is used. The primary difficulty of implementing this approach is the toxicity of HF. As a result, the NaOH/KOH approach is preferable from a convenience of handling materials perspective, as well as from personnel safety perspective.

Additionally, not all chemicals that can be used as a reactive agent as described need be in a powder form. A similar effect could be produced by using a gaseous reactive agent, or by using a liquid reactive agent and then constraining the reactive agent within the hull. When gas or liquid reactive agents are used, however, the reactive agents must be placed within a watertight container so that the reactive agent does not contact the hull and start the corrosive action until it is time to do so. One example of a gas system would be the use of hydrogen fluoride contained in a vessel, which floods, forming hydrofluoric acid, which in turn decomposes a glass structure (such as an undersea buoyancy sphere, optics, or anything else made of glass). This structure for these embodiments will be described in more detail below.

The advantage of the chemically induced means of causing decay in a structure is that it can be deliberately triggered, it can be timed, and it can allow a structure to maintain full strength until such time as it is discarded. Additionally, a chemically induced means of decomposition, whether caused by destabilizing an oxide layer, which allows seawater to act as the solvent, or through the application of a chemical which directly acts as a solvent to the structure, will act significantly faster than previously contemplated galvanic methods as known and described in the prior art.

Figure 2:
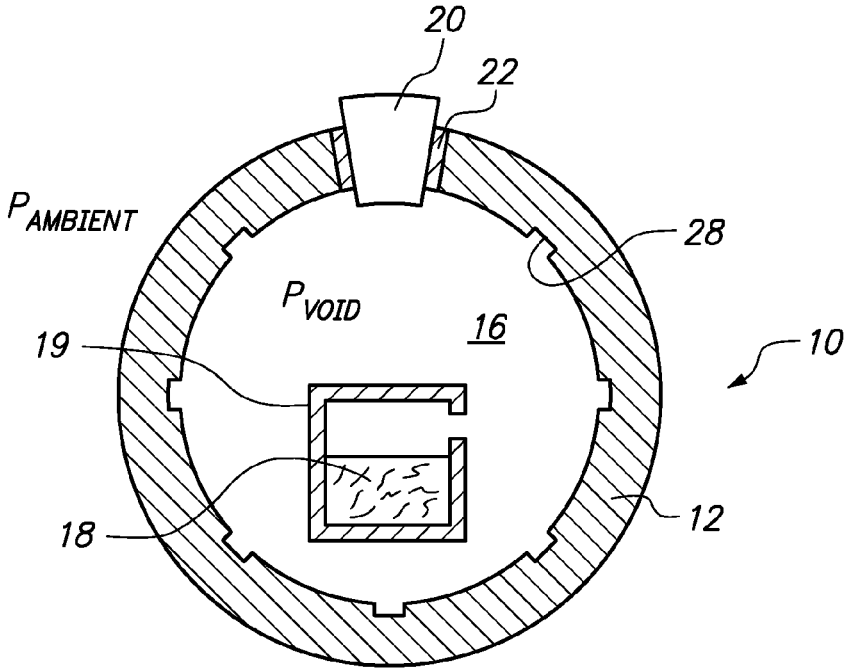
FIG. 2 is a cross-sectional view of the self-scuttling vessel according to several embodiments of the present invention.
Figure 3:
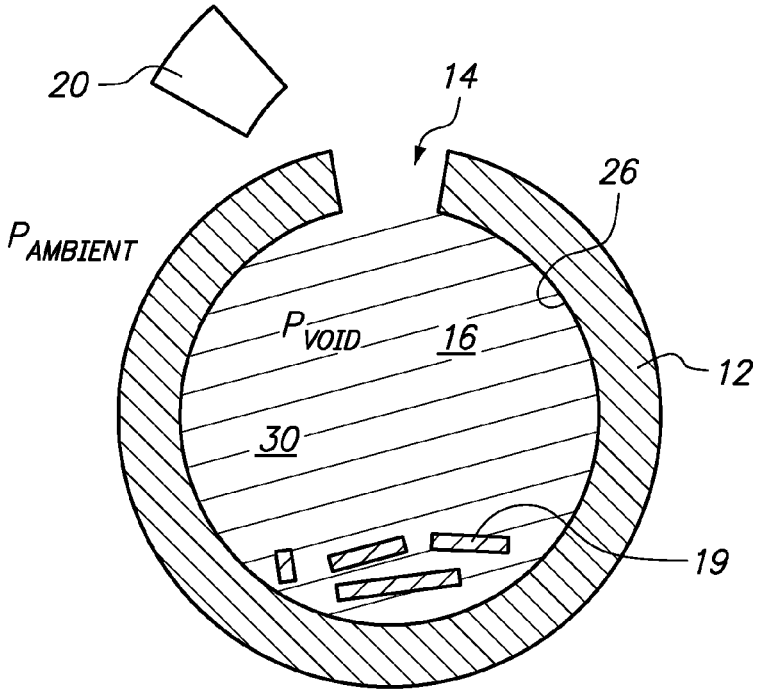
FIG. 3 is a cross-sectional view of the self-scuttling vessel of FIG. 2, which illustrates how the reactive agent becomes deployed once fluid communication has been established between an interior void of the self-scuttling vessel and the surrounding underwater environment.

Referring now to FIGS. 2 and 3, a self-scuttling vessel according to several embodiments of the present invention is shown and is generally designated by reference character 10. As shown, vessel 10 can include a pressure hull 12, which is further formed with at least one fill port 14 (Please see FIG. 3, the size of the fill port 14 relative to the pressure hull in FIG. 3 is greatly exaggerated for clarity of description). In most embodiments, the fill port 14 could be small relative to the hull, so that the rate of ion exchange with the open ocean is limited once a reactive agent 18 is deployed as described below. The hull 12 can define at internal void 16 for the vessel 10, and a reactive agent 18 can be disposed within the void 16, or within a container 19 that can be disposed within the void 16, as shown in FIG. 2. A plug 20 and explosive charge 22 can be inserted into fill port 14 that establish watertight integrity between the vessel and its underwater environment. Or, in still other embodiments, a material (not shown) that is selected to deteriorate after a preselected amount of time can be inserted into fill port 14.

With the configuration described above, the internal void pressure $P_{VOID}$, which can be assumed to be roughly atmospheric pressure prior to deployment of the vessel 10, remains the same while the ambient pressure around the vessel $P_{AMBIENT}$ increases as the vessel is lowered to greater depths. One alternative to the plug and explosive charge configuration described above could be to fix a remotely actuated valve within fill port 14, and then open the valve when it is time to flood the void 16.

For the invention according to several embodiments, the reactive agent 18 is chosen so that once it mixes with seawater to establish solution 30, the most thermodynamically stable species of the hull material is soluble in solution 30, i.e. the reactive agent 18 is chosen so that it chemically reacts with hull 12 to corrode hull 12 when in solution 30. For an Aluminum hull 12, a NaOH or KOH reactive agent could be used in several embodiments. It should be appreciated, however that other reactive agents could be used with Al, and that still other reactive agents might be more optimal if the hull is made of other materials. For the vessel shown in FIG. 2 the container 19 can be made of a flexible material and formed with a container opening 24. In other embodiments, however, particularly in embodiments where the reactive agent 18 is in liquid or gaseous form, a watertight container 19 can be used. For these embodiments, the container is made of a material that maintains watertight at $P_{VOID}$, but that loses watertight integrity at $P_{AMBIENT}$. One such embodiment could be a container 19 that is formed as a glass ampule, which could crush at $P_{AMBIENT}$ when void 16 is flooded to thereby deploy the reactive agent 18.

Figure 4:
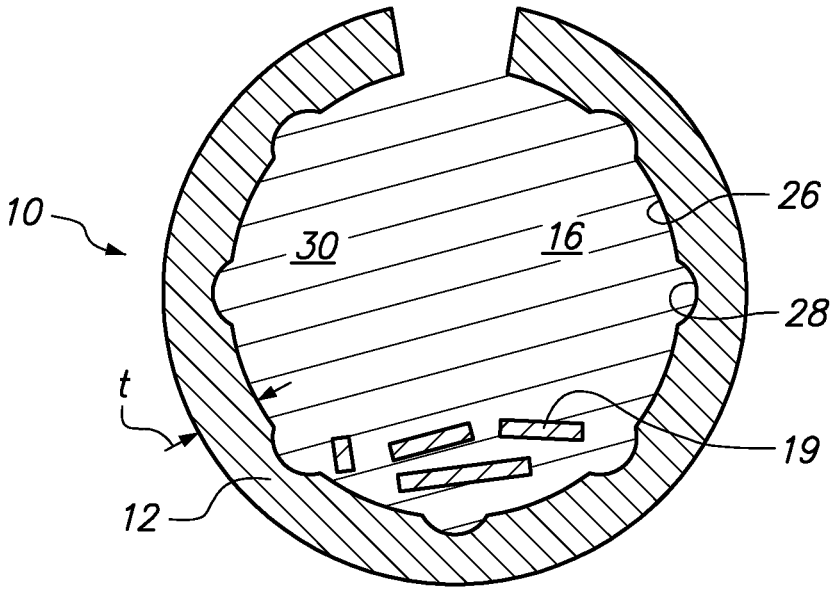
FIG. 4 is the same view of FIG. 3, but after the reactive agent has had time to corrode the vessel hull.
Figure 5:
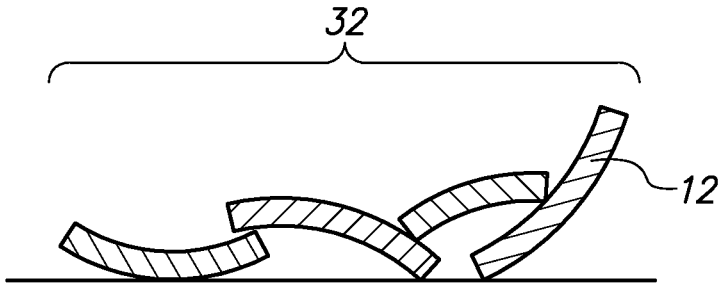
FIG. 5 is the same view of FIG. 3 after the hull has disintegrated (scuttled) and the reactive agent has dispersed in the underwater environment; and, FIG. 6 is a block diagram, which illustrates steps that can be taken to accomplish the methods according to several embodiments of the present invention.

Referring now to FIGS. 3-5, the operation of the self-scuttling vessel can be described. Upon detonation of explosive charge 22 to force plug 20 out of fill port 14 (or upon opening of a remotely actuated valve fixed in fill port 14 in alternative embodiments, the valve is not shown in the Figures), fluid communication can be established between the ambient surroundings and the void 16. When this occurs, $P_{AMBIENT}$ and $P_{VOID}$ equalize as void 16 fills with seawater. As this occurs, in cases when container 19 is itself a watertight structure, the container 19 fails, which causes reactive agent 18 to come in contact the seawater inside void 16 to establish agent/seawater solution 30. For hull materials made of Al, and a reactive agent 18 of NaOH or KOH, this causes a corrosive chemical reaction to begin acting on the inside surface 26 of hull 12.

In several embodiments, interior surface 26 can be scored with a plurality of scores 28. FIG. 2 is illustrative of these embodiments. For these embodiments, once the chemical corrosive action of solution 30 begins, the scores can supply predetermined weakness points, which can cause the hull to disintegrate in a predetermined fashion along the scores 28. The number and geometry of the scores can be chosen according to the needs of the user, taken into account such factors as ease of manufacture, and assembly of hull 12. With this configuration, vessels can selectively decay and then fall apart into discrete sections, in a known and quantifiable fashion without the requirement of creating pre-designed pathways FIG. 4 illustrates a vessel 10 for which the self-scuttling process is well underway. As shown in FIG. 4, the reactive agent 18 and seawater have mixed within void 16 to establish an agent/seawater solution 30. The solution 30 has begun chemically reacting with interior surface 26, which is made of Al. As the Al hull began to corrode, the thickness "t" of hull 14 began to decrease, particularly in the areas of the scores 28 (for those embodiments where the interior surface 26 is scored).

In FIG. 5, the scuttling process is complete. The hull 12 has broken up into a debris field 32, which can pose less of a navigational hazard than the original form of hull 12.

Figure 6:
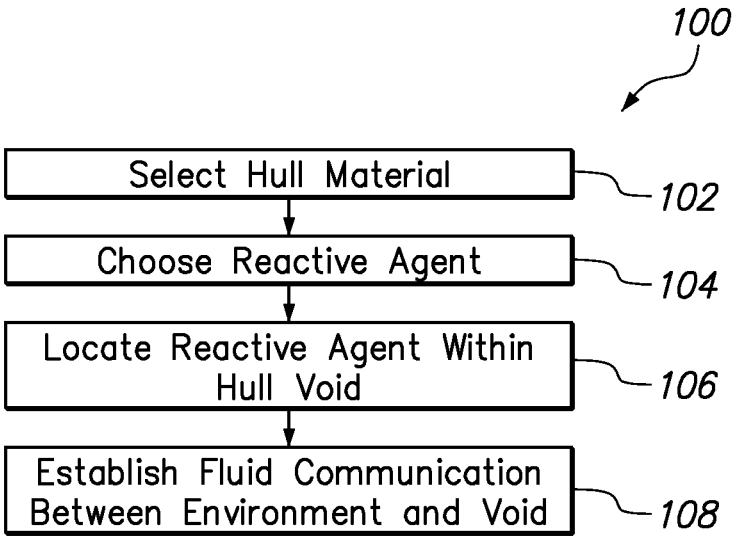

Referring now to FIG. 6, a block diagram illustrating the methods according to several embodiments can be shown and referenced by character 100. As shown, the methods according to several embodiments can include the initial step 102 of selecting a hull material for use as pressure hull 12. The methods can also include the step 104 of choosing a reactive material. The reactive agent 18 can be chosen accordingly the hull material, so that a chemical reaction is generated when the reactive agent is mixed with an electrolytic seawater environment to establish a solution 30 having a pH of less than 4.0 or greater than 8, as described above. Reactive bases such as NaOH or KOH could be used, as well as reactive acids such as HF, as described above.

The methods according to several embodiments can further include the step 106 of locating the reactive agent within a watertight void 16 of the pressure hull 12. Step 106 can be accomplished using a flexible container 19 that is formed with a container opening 24, as described above. The reactive agent 18 can be placed within container 19, and container 19 can then be placed within void 16. Or, a watertight structure such as a glass ampule could be used for container 19. For these embodiments, the reactive agent 18 is placed within the ampule (container 19), and the ampule is then placed within void 16.

Once the reactive agent 18 is located within void according to the various embodiments of the present invention, the methods according to several embodiments can further include the step 108 of selectively establishing fluid communication between the surround undersea environments and the internal void 16 of pressure hull 12. The establishing step 108 can be accomplished using a remotely actuated valve, which can be placed in a fill port that established in the hull 12, as described above. Alternatively, an explosive charge 22 and plug 20 can be inserted into fill port 14, as also described above. The explosive charge 22 can be detonated to blow plug 20 out of fill port 14. Once this occurs, the void 16 fills with seawater and crushes the glass ampule container 19.

Once container 19 is crushed, or in embodiments where container is made of a flexible material and reactive agent is urged out of container opening 24, the reactive agent 18 therein becomes exposed to seawater and establishes a seawater/agent solution 30, as described above. The solution 30 chemically reacts with interior surface 26 of hull 12 to thereby corrode the hull. If the hull is formed with scores 28, the hull continues to corrode until the hull 12 fails along scores 28. In this manner, the vessel scuttles, which results in debris field 32, as described above.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A self-scuttling device disposed in an underwater environment, comprising:

a pressure hull made of a preselected hull material, said pressure hull defining an internal void having an internal pressure $P_{VOID}$;

a means for selectively establishing fluid communication between said environment and said void to selectively flood said void with a fluid;

a reactive agent located within said void, said reactive agent mixing with said fluid to establish a solution within said void when said void is flooded; and, said reactive agent being chosen to modify the pH of said solution such that the most thermodynamically stable species of said hull material is soluble in said solution, to thereby cause corrosion of said pressure hull when said void is flooded with said fluid.

2. The device of claim 1 wherein said device is disposed in said underwater environment at a pressure $P_{AMBIENT}$, wherein $P_{AMBIENT}$ is greater than $P_{VOID}$, and further wherein:

said reactive agent is disposed within a watertight container located within said void; and, said container is made of a material that maintains watertight integrity at $P_{VOID}$, but that loses watertight integrity at $P_{AMBIENT}$.

3. The device of claim 1 wherein said device is disposed in said underwater environment at a pressure $P_{AMBIENT}$, and further wherein:

said reactive agent is disposed within a container;

said container is made of a flexible material and is formed with at least one opening; and, when fluid communication is established between said underwater environment and said void and while $P_{AMBIENT}$ is greater than $P_{VOID}$, said flexible material yields to force said reactive agent out of said at least one opening.

4. The device of claim 1 wherein said fluid communication means further comprises:

a fill port formed in said pressure hull; and, a remotely operated valve disposed in said fill port.

5. The device of claim 1 wherein said fluid communications means further comprises:

a fill port formed in said pressure hull; and, said fill port being covered by a material that is selected to deteriorate after a predetermined amount of time to thereby establish fluid communication between said underwater environment and said void.

6. The device of claim 1 wherein said fluid communications means further comprises:

a fill port formed in said pressure hull;

a plug inserted into said fill port;

an explosive charge inserted into said fill port; and, a means for remotely detonating said explosive charge to blow said plug out of said opening to thereby establish fluid communication between said underwater environment and said void.

7. The device of claim 1 wherein said pressure hull material is Aluminum and said reactive agent chosen from the group consisting of sodium hydroxide (NaOH) and potassium hydroxide (KOH).

8. The device of claim 1 wherein said pressure hull has an internal surface and external surface, and wherein said internal surface is scored to establish score lines in said pressure hull.

9. The device of claim 1 wherein said solution has a pH of below 4 or above 8.

10. A method for scuttling a device, said device having a pressure hull that defines an internal void, said internal void having an internal pressure $P_{VOID}$, said device being disposed in an underwater environment, said method comprising the steps of:

A) selecting a hull material for said pressure hull;

B) choosing a reactive agent according said hull material, said reactive agent being chosen such that when said reactive agent combines with a fluid to establish a solution, the most thermodynamically stable species of said hull material is soluble in said solution;

C) locating said reactive agent within said void; and,

D) selectively flooding said void with said fluid to thereby cause corrosion of said pressure hull.

11. The method of claim 10 wherein said device is disposed in said underwater environment at a pressure $P_{AMBIENT}$, wherein said $P_{AMBIENT}$ is greater than said $P_{VOID}$, and wherein said step C) further comprises the steps of:

C1) disposing said reactive agent within a watertight container located within said void; and, C2) selecting a material for said container so that said container maintains watertight integrity at $P_{VOID}$, but loses watertight integrity at $P_{AMBIENT}$.

12. The method of claim 10 wherein said device is disposed in said underwater environment at a pressure $P_{AMBIENT}$, and wherein said step C) further comprises the steps of:

C1) providing a container within said void, said container being made of a flexible material and formed with at least one opening;

C2) disposing said reactive agent within said container so that said flexible materials yields to force said reactive agent out of said at least one opening while $P_{VOID}$ is less than $P_{AMBIENT}$ when said step D) is accomplished.

13. The method of claim 10 wherein said step D) further comprises the steps of:

D1) forming a fill port in said pressure hull;

D2) disposing a remotely operated valve disposed in said fill port; and,

D3) selectively opening said valve.

14. The method of claim 10 wherein said step D) further comprises the steps of:

D1) forming a fill port in said pressure hull; and,

D2) covering said fill port with a material that is selected to deteriorate after a predetermined amount of time.

15. The method of claim 10 wherein said step D) further comprises the steps of:

D1) forming a fill port in said pressure hull;

D2) plugging said fill port with a plug,

D3) placing an explosive charge in said fill port along with said plug; and,

D4) detonating said explosive charge to blow said plug out of said fill port.

16. The method of claim 10 wherein said step A) is accomplished using a pressure hull material made of Aluminum (Al).

17. The method of claim 10 wherein said step B) is accomplished using a reactive agent chosen from the group consisting of sodium hydroxide (NaOH) and potassium hydroxide (KOH).

18. The method of claim 10 wherein said pressure hull has an internal surface and external surface, and further comprising the step of:

E) scoring said internal surface.

* * * * *